US007442072B2

(12) United States Patent
Droesbeke et al.

(10) Patent No.: US 7,442,072 B2
(45) Date of Patent: Oct. 28, 2008

(54) CABLE CONNECTOR AND METHOD OF ASSEMBLING A CABLE TO SUCH A CABLE CONNECTOR

(75) Inventors: Gert Droesbeke, Geel (BE); Nico Van Stiphout, Beek en Donk (NL); Léonard Van Kuijk, Oosterhout (NL)

(73) Assignee: FCI, Versailles (FR)

( * ) Notice: Subject to any disclaimer, the term of this patent is extended or adjusted under 35 U.S.C. 154(b) by 53 days.

(21) Appl. No.: 11/597,739

(22) PCT Filed: Jun. 20, 2005

(86) PCT No.: PCT/EP2005/006584

§ 371 (c)(1),
(2), (4) Date: Nov. 27, 2006

(87) PCT Pub. No.: WO2005/124935

PCT Pub. Date: Dec. 29, 2005

(65) Prior Publication Data

US 2007/0224876 A1 Sep. 27, 2007

(30) Foreign Application Priority Data

Jun. 18, 2004 (NL) ..... 1026451

(51) Int. Cl.
*H01R 13/58* (2006.01)

(52) U.S. Cl. ..... 439/471; 439/460; 439/610

(58) Field of Classification Search ..... 439/607, 439/610, 471, 460

See application file for complete search history.

(56) References Cited

U.S. PATENT DOCUMENTS

| | | | | |
|---|---|---|---|---|
| 4,272,148 | A | 6/1981 | Knack, Jr. | 339/143 |
| 4,781,623 | A * | 11/1988 | Philippson et al. | 439/670 |
| 4,889,503 | A * | 12/1989 | Philippson et al. | 439/610 |
| 4,963,104 | A | 10/1990 | Dickie | 439/460 |
| 5,831,815 | A | 11/1998 | Miller et al. | 361/679 |
| 6,007,370 | A | 12/1999 | Langridge | 439/455 |
| 6,036,543 | A * | 3/2000 | Panis et al. | 439/607 |
| 6,203,377 | B1 * | 3/2001 | Grek et al. | 439/610 |
| 6,319,040 | B1 | 11/2001 | Chang | 439/352 |
| 6,428,359 | B2 * | 8/2002 | Van Zanten | 439/610 |
| 6,705,894 | B1 * | 3/2004 | Comerci et al. | 439/607 |
| 6,811,441 | B2 * | 11/2004 | Simpson | 439/610 |
| 7,074,087 | B2 * | 7/2006 | Szczesny et al. | 439/610 |

FOREIGN PATENT DOCUMENTS

| | | | |
|---|---|---|---|
| DE | 30 33 211 | A1 | 4/1982 |
| EP | 0 986 135 | A1 | 3/2000 |
| EP | 1 024 561 | A2 | 8/2000 |
| WO | WO 02/060012 | A1 | 8/2002 |
| WO | WO 2004/057707 | A1 | 7/2004 |

* cited by examiner

*Primary Examiner*—Briggitte R Hammond
(74) *Attorney, Agent, or Firm*—Harrington & Smtih, PC

(57) ABSTRACT

The invention relates to a cable connector including a housing with a base substantially extending between a front side and a rear side of said connector and a first housing part mountable to said base such that said first housing part and a first portion of said base determine a cable passage configured to accommodate a ferrule arrangement of a cable. The cable passage includes at least one recessed portion configured to receive a corresponding protrusion of said ferrule arrangement or vice versa Accordingly a high density cable connector is obtained with improved cable relief performance.

11 Claims, 6 Drawing Sheets

CABLE CONNECTOR AND METHOD OF ASSEMBLING A CABLE TO SUCH A CABLE CONNECTOR

The invention relates to a cable connector comprising a housing with a base substantially extending between a front side and a rear side of said connector and a first housing part mountable to said base such that said first housing part and a first portion of said base determine a cable passage configured to accommodate a ferrule arrangement of a cable.

Nowadays, cable connectors in e.g. telecom applications have to meet a package of ever increasing requirements relating to e.g. robustness, quality of assembly, aesthetical considerations, density, shielding etc.

International patent application PCT/EP03/50993 of the same applicant describes a cable connector comprising a housing having a die cast base substantially extending between a front side and a rear side of the connector. A die cast first housing part is mounted to the die cast base such that said die cast first housing part and a first portion of said die cast base determine a first cable connector portion at the rear side. A metal sheet formed second housing part mounted to the die cast base such that the metal sheet formed second housing part and a second portion of said die cast base determine a second cable connector portion at said front side. Such a cable connector combines a die cast base with a metal sheet formed housing part at the front side. The metal sheet formed housing part provides the possibility to limit the front side wall thickness of the cable connector housing, such that the front side of this cable connector can be inserted in a connecting panel with openings of smaller dimensions, while still using die cast parts. Die cast parts generally allow a large freedom with respect to shapability of such a part. The die-case base which extends between the front side and the back side of the entire housing provides rigidity to this cable connector.

These cable connectors face severe requirements when applied in the field. Typically, considerable strain and torsion forces are exerted on the cables of such connectors when they are connected in a cabinet of small dimensions. On the other hand, the high density requirements for contemporary cable connectors forbid complicated, space consuming cable relief arrangements to withstand these forces.

It is an object of the invention to provide a cable connector as described above with an improved cable relief arrangement while complying with high density requirements.

This object is achieved by providing a cable connector characterized in that said cable passage and said ferrule arrangement are provided with cooperating means for locking the ferrule arrangement in the cable passage comprising at least one recessed portion configured to receive a corresponding protrusion.

Preferably, said cable passage comprises the at least one recessed portion configured to receive a corresponding protrusion of said ferrule arrangement.

The improved cable relief performance of the cable connector according to the invention results from the interaction of the recessed portion in the cable passage or the ferrule arrangement and the protrusion of the ferrule arrangement or the cable passage. This interaction provides twist relief for the cable, such that torsion forces exerted on the cable are not transmitted to terminating wires of the cable but are consumed by the cable connector housing. Further, the interaction provides immediate pull relief and bend relief when the cable connector is assembled. However, by only having a recess in a portion of the cable passage or ferrule arrangement instead of a recess surrounding the entire passage, the dimensions of the cable connector housing maintain to be small resulting in a high density cable connector.

A further advantage of the recessed portion relates to the termination process for the wires of the cables. Although the cable connector according to the invention has an improved cable relief performance, still forces, exerted on the cable, may be transferred to the termination points of the wires due to so-called pistoning of the individual wires. Consequently, a failed connection of one or more of the wires may result. The recessed portion provides a precise assembly datum enabling the individual wires to be cut to take a pre-curved shape. Accordingly, any remaining forces transmitted to the wires can be consumed by the extra length of the wires and will not break the contact of the wires at the termination points.

In an embodiment of the invention, the cable connector further comprises a metal sheet formed second housing part mounted to said base such that said metal sheet formed second housing part and a second portion of said base determine a second cable connector portion at said front side. The metal sheet formed housing part provides the possibility to limit the front side wall thickness of the cable connector housing, such that the front side of this cable connector can be inserted in a connecting panel with openings of small dimensions, i.e. a high density cable connector is obtained. Preferably, the second housing part comprises one or more mount beams for mounting said housing part to said first housing part and said first housing part comprises a pressing structure to force said mount beams into said cable passage. Regardless any tolerances of the different parts, the pressing structure drives the mount beams against the ferrule arrangement to short circuit all elements of the cable connector with the shielding sheath, also referred to as braid, of the cable to ensure appropriate electromagnetic shielding.

Further embodiments are presented in the dependent claims and are described in more detail below.

The invention also relates to a method of assembling a cable in a cable connector as described above, said cable comprising a plurality of wires, a shielding sheath and an outer cable jacket, comprising the steps of:

- stripping a portion of said cable jacket to expose a portion of said shielding sheath and cutting said shielding sheath to obtain an exposed sheath portion;
- applying an inner ferrule of said ferrule arrangement over said outer cable jacket;
- folding said exposed sheath portion backwards over said inner ferrule and applying an outer ferrule with said protrusion over said cable to substantially sandwich said backward folded sheath portion between said inner ferrule and said outer ferrule;
- first connecting said wires to one or more termination block of said cable connector and subsequently crimping said outer ferrule on said cable, said outer ferrule being positioned to have said protrusion received in said recessed portion of said cable passage.

Such a cable assembly process, wherein the wires are first connected to the termination points followed by the crimping process of the ferrule arrangement, allows for terminating the wires to obtain a controllable extra length for the wires. The advantage of this extra length for the wires is explained above. Further, the shielding sheath or braid can be stripped with big tolerances since the end of the sheath is folded backwards to sandwich it between the inner and outer ferrule. Trimming of the sheath after crimping is therefore not needed. Moreover, sheath portions, cut accidentally from the sheath during the crimping process, will remain between the inner and outer ferrule and not in the cable connector portions where such sheath portions might cause electrical arc over.

U.S. Pat. No. 6,231,392 discloses a cable connector having improved strain relief. A strain relief member is provided comprising a ferrule and a plate with a central opening surrounding the ferrule. Obviously, by having the plate surrounding the entire ferrule, more space is required to accommodate the plate in the housing compared to the cable connector according to the invention. Further a clamping member is only applied after having closed the housing parts. Thereby a visual inspection of the wired connector is not possible anymore before crimping the clamping member. Finally, during cable assembly, the braid is not folded back between the ferrule and the clamping member ring, inter alia resulting in the drawbacks mentioned above.

The invention will be further illustrated with reference to the attached drawings, which schematically show a preferred embodiment according to the invention. It will be understood that the invention is not in any way restricted to this specific and preferred embodiment.

Figures 1A, 1B:
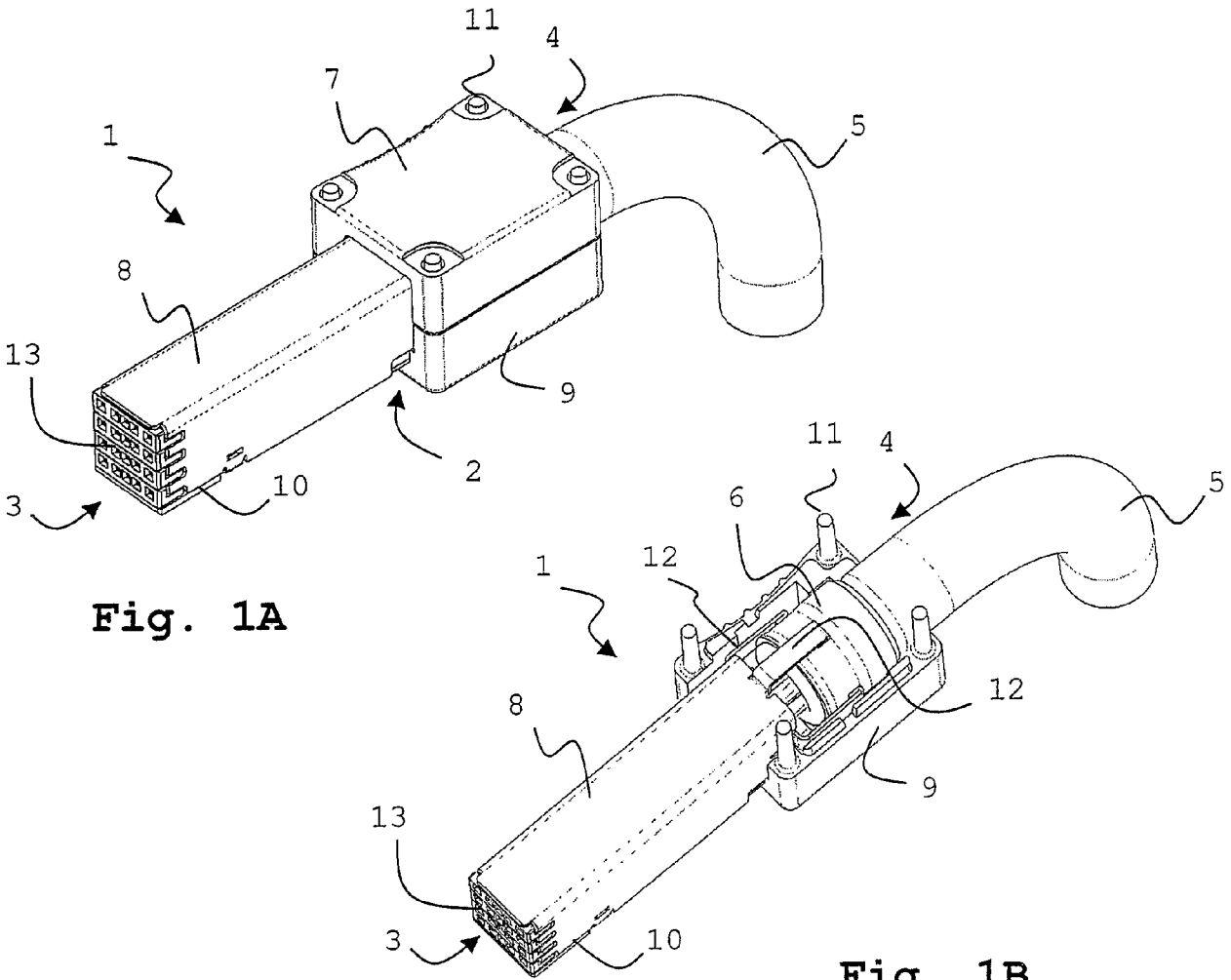
FIGS. 1A and 1B show a cable connector according to an embodiment of the invention.

In FIGS. 1A and B an I/O 8-pair twinax cable connector 1 is shown, comprising a die cast base 2, hereinafter also referred to as base 2, extending between a front side 3 and a rear side 4. A cable 5 provided with a ferrule arrangement 6 is assembled to the connector 1 at the rear side 4. The connector 1 further comprises a die cast first housing part 7 and a metal sheet formed second housing part 8. Housing parts 7 and 8 are modular parts, i.e. they are separate components adapted to engage with the base 2. The base 2 comprises a first portion 9 determining a cable passage with the first housing part 7 and a second portion 10 determining a second connector portion with the second housing part 8. The base 2 comprises mounting structures 11 to mount the first housing part 7 to the base 2. Mount beams 12 are provided to mount the second sheet metal housing part 8 to the first housing 7. The mount beams 12 provide an electrical connection between the housing part 8 and the ferrule arrangement 6. Termination blocks 13 for terminating wires (see FIG. 3) of the cable 5 are provided near the front side 3 of the cable connector 1.

Further technical details of the cable connector 1 are provided in international patent application PCT/EP03/50993 of the same applicant, which is herewith incorporated by reference with respect to the die cast base 2, the first housing part 7 and the second housing part 8.

Figure 2B:
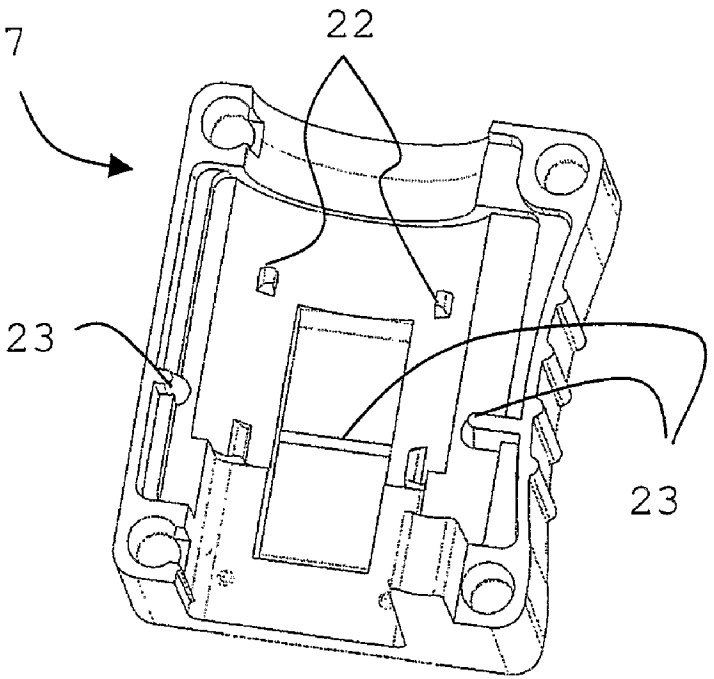
FIGS. 2A and 2B show cable connector housing parts of the cable connector of FIGS. 1A and 1B.
Figure 2A:
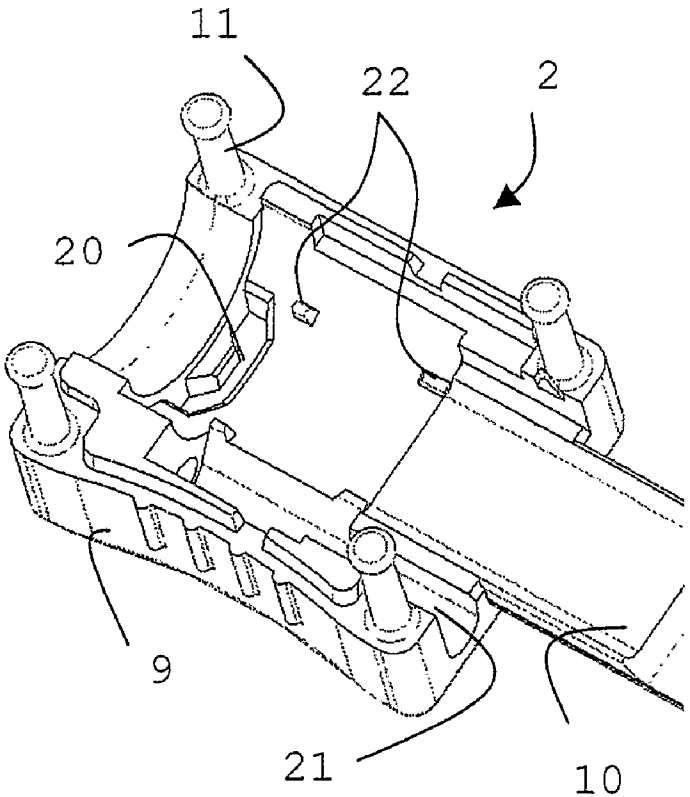

FIGS. 2A and 2B respectively show detailed views of the first portion 9 of the base 2 and the first housing part 7 that together form the cable passage of the cable connector 1. Clearly, the first portion 9 of the die cast base 2 comprises a recessed portion or slot 20. Die cast materials allow complicated shapes and accordingly complicated recesses can easily be manufactured in the die cast portions of the cable connector 1. The recessed portion 20 is only provided in a limited part of the cable passage to obtain a high density cable connector. Further the first portion 9 comprises an elongated recess 21 to accommodate a screw for attaching the cable connector to a panel, counter connector or board connector. Finally the first portion 9 determining the cable passage comprises ribs 22 to fixate the ferrule arrangement 6.

The first housing part 7 also comprises ribs 22 for fixating the ferrule arrangement 6. Further, pressing structures 23 are provided to clamp the second housing part 8 against the ferrule arrangement 6 by forcing the mount beams 12 into the cable passage. Accordingly, an appropriately shielded high density cable connector 1 is obtained.

Figure 3A:
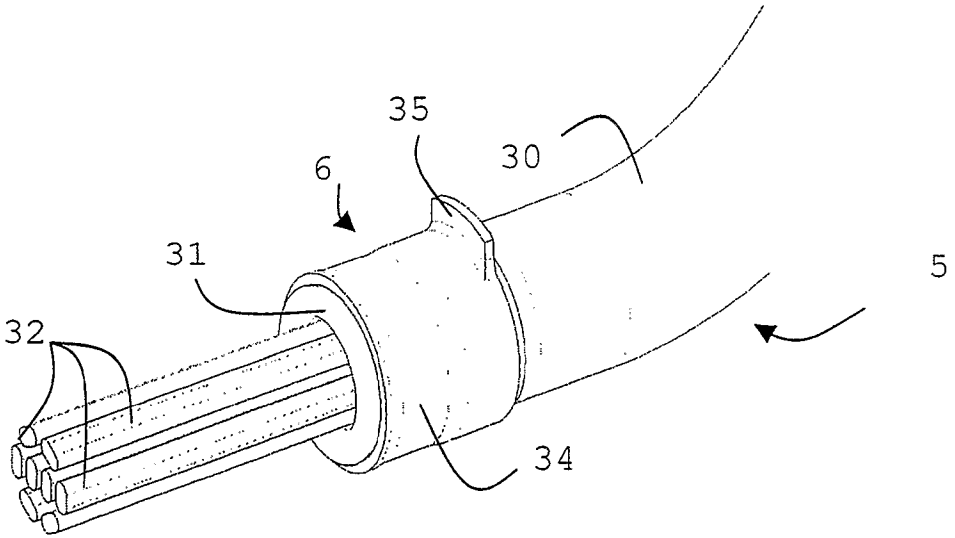
FIGS. 3A and 3B show a cable with a ferrule arrangement according to an embodiment of the invention.
Figure 3B:
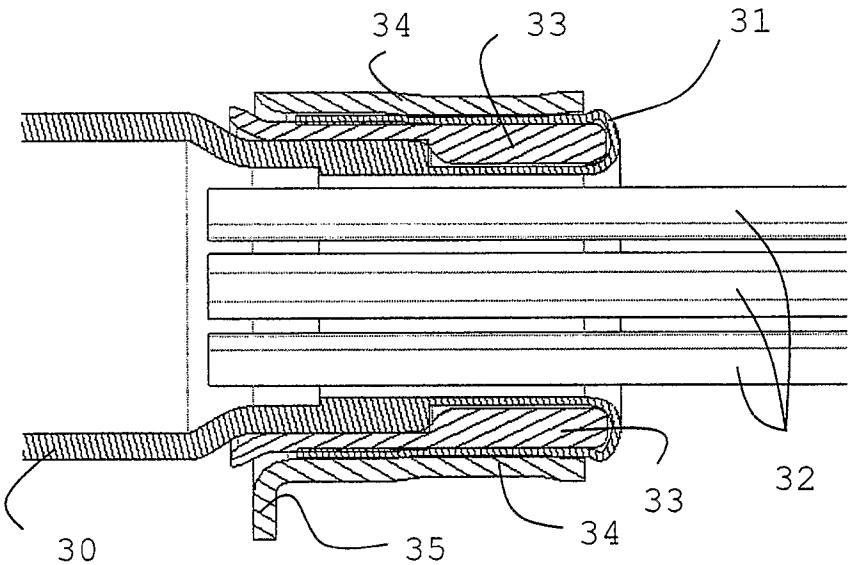

FIGS. 3A and 3B show a cable 5 with a ferrule arrangement 6 according to an embodiment of the invention.

The cable 5 comprises an outer cable jacket 30, a shielding sheath or braid 31 and a plurality of wires 32. The wires 32 are isolated twin-axial pairs.

The ferrule arrangement 6 comprises an inner ferrule 33 and an outer ferrule 34 having a protrusion 35 extending from the outer surface of the outer ferrule 34 in a radial direction. Such a ferrule configuration 6 allows to accommodate cables 5 of various diameters in the cable connector 1, without needing to modify the outer ferrule 35 to clamp to the first portion 9 of the base 2. The protrusion or flange 35 is only present along a portion of the circumference of the outer surface, i.e. it is configured to cooperate with the recessed portion 20 in the die cast base 2.

The cable 5 is assembled to the cable connector 1 as follows. First a portion of the cable jacket 30 is stripped to expose a portion of the braid 31. The braid 31 is cut to obtain an exposed braid portion. The inner ferrule 33 is slid over the outer cable jacket 30. The inner ferrule 33 has an inner diameter which is smaller at the front part as at the back part so that an inner circumferential shoulder 33' is obtained which meets the cable outer jacket 30. The inner ferrule 33 may be crimped onto the cable jacket 30. As shown in FIG. 3B, subsequently the exposed braid portion is folded backwards over the inner ferrule 33 and the outer ferrule 34 with the protrusion 35 is applied over the cable 5 to sandwich the backward folded braid portion between the inner ferrule 33 and the outer ferrule 34. Subsequently, first the wires 32 are connected to the termination block 13 and subsequently the outer ferrule 34 is crimped on the cable 5. All tolerances in the assembly operation described can consequently be compensated for by delaying the crimping operation of the outer ferrule 34 until this moment. The outer ferrule is positioned such that the position of the partial flange 35 allows the recessed portion 20 to receive this flange 35. The flange 35 is pressed into the recessed portion 20. The reference positions provided by on the one hand the position of the termination blocks 13 and on the other hand the position of the recessed portion 20 enable an additional length for wires 32 such that they are slightly curved (not shown). Finally, the covers 7 and 8 are mounted on the base 2 thereby clamping the ferrule arrangement 6 into the cable connector 1.

Figure 4:
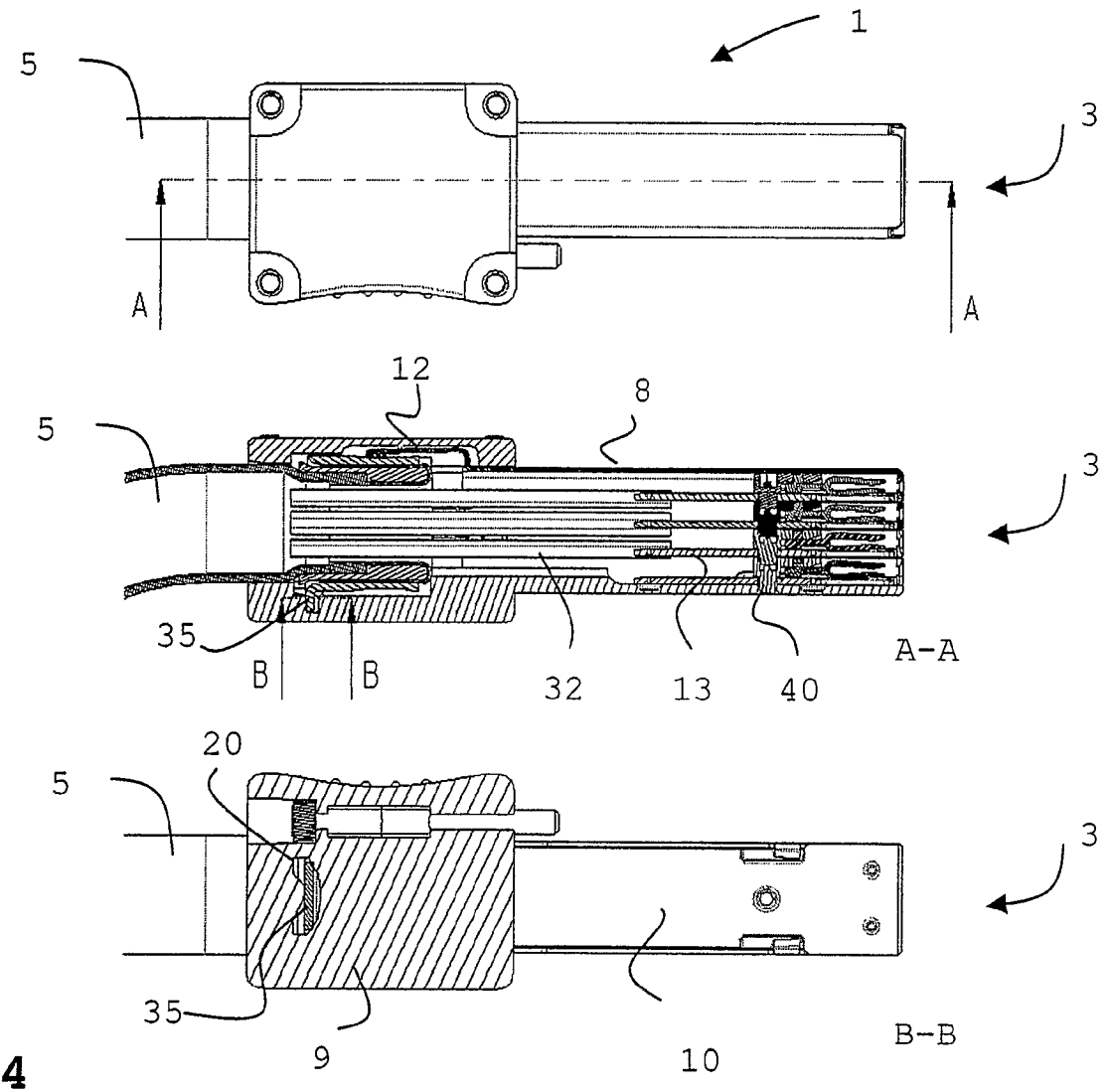
FIG. 4 shows cross-sections of the cable connector of FIG. 1A.
Figure 5B:
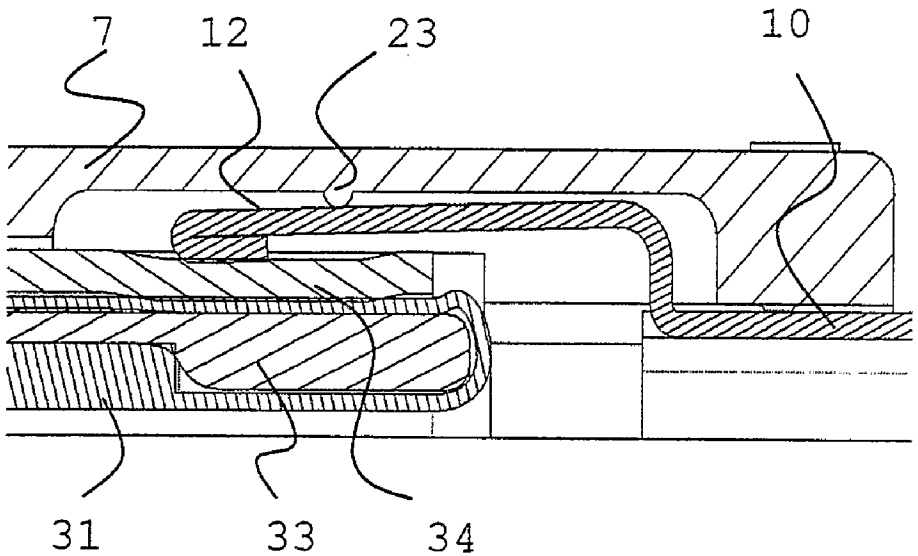
FIGS. 5A and 5B show detailed parts of the cross-sections shown in FIG. 4.
Figure 5A:
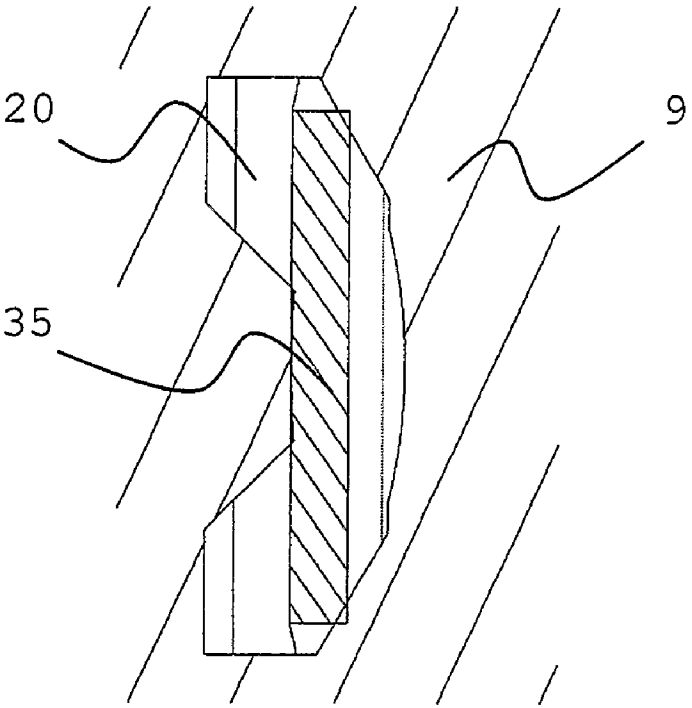

FIGS. 4, 5A and 5B show various cross-sections of the cable connector 1 with an assembled cable 5. Identical reference numbers indicate identical features of the cable connector 1 or the cable 5.

In FIG. 4 a positioning structure 40 to position the termination blocks 13 is shown. This positioning structure or peg 40 is used to accurately position the terminal blocks 13 to provide another datum or reference position for terminating the wires 32 of the cable 5 as described above.

FIG. 5A shows the shape of the recessed portion 20. This recessed portion 20 is configured such that it has a tight fit with the protrusion 35 of the ferrule assembly 6. The protrusion 35 interferes with the boundaries of the recessed portion 20.

FIG. 5B shows a clear illustration of the force exerted on the mount beam 12 of the metal sheet formed housing part 8 by the pressing structure 23. The mount beam 12 is driven against the ferrule arrangement 6, i.e. the outer ferrule 34, so that the second housing part 8 is electrically short circuited with the ferrule arrangement and thereby with the braid 31.

Figure 6B:
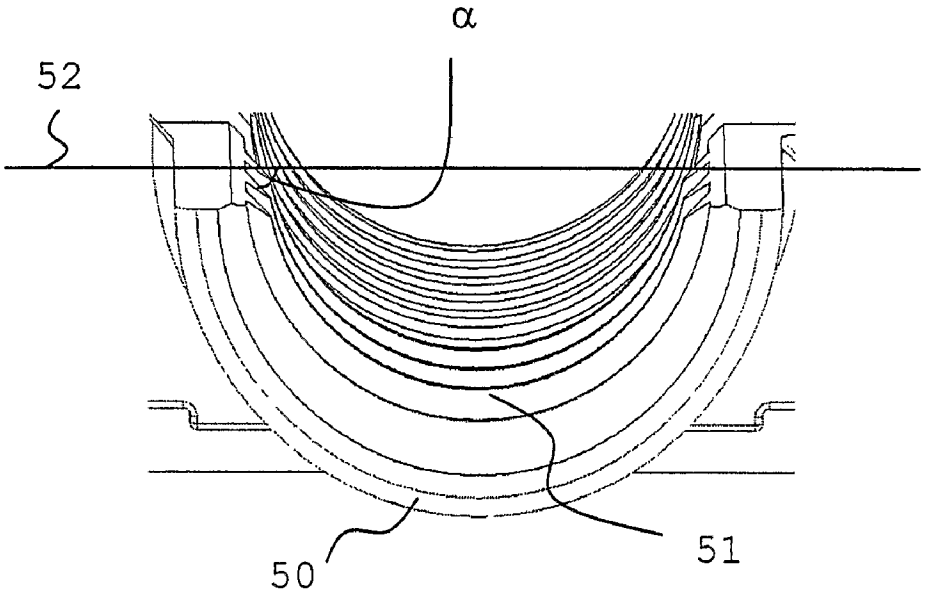
FIGS. 6A and 6B shows a cable entry of the cable connector of FIG. 1A without a cable.
Figure 6A:
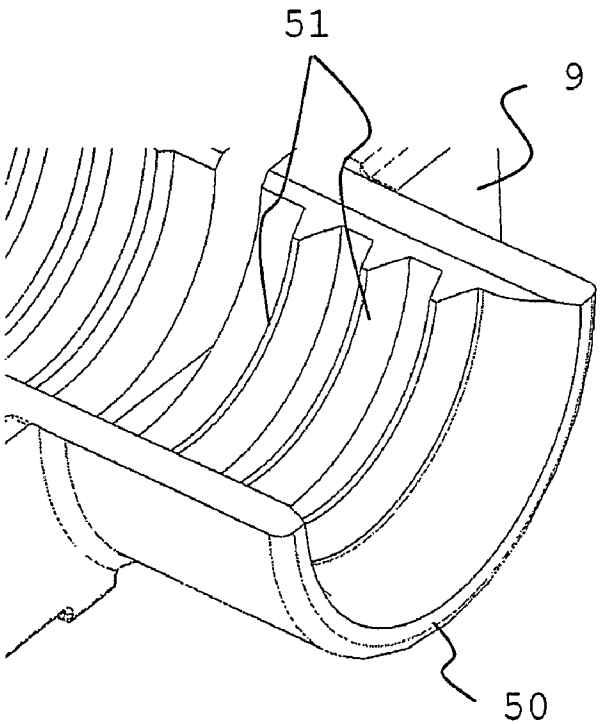

Finally, in FIG. 6 the cable entry 50 at the rear part 4 of the cable passage is shown. The cable entry 50 comprises a plurality of retention ribs 51 contributing to relief performance of the cable connector 1. The retention ribs are configured to fix the cable 5 by firmly gripping of the outer cable jacket 30. A split plane 52 is defined by the first portion 9 of the base 2 and the first housing 7 (not shown in FIGS. 6A and 6B for clarity purposes). The retention ribs 51 are chamfered with respect to the split plane 52 over an angle a of 450. Consequently, during closure of the cable connector housing by mounting the first housing 7 onto the base 2, the cable jacket 30 has room to set in the space provided by the chamfered retention ribs near the split plane 52.

It is noted that although in the embodiment described the first portion 9 comprises one slot 20, more slots can be provided in the cable passage determined by the first portion 9 and the first housing part 7. Further, the first portion 9 and housing part 7 could have one or more protrusions 35 and the ferrule arrangement 6 could have one or more slots configured to receive the protrusions. It is also possible to have both protrusions and slots on both parts. The ferrule arrangement 6 may comprise a single ferrule, in particular in case of a non-shielded connector and cable without braid. Moreover the ferrule arrangement may only partially be accommodated in the cable passage.

It is noted that the invention is not limited to the cable connector 1 disclosed above, as multiple modifications, such as applying the invention to cable connectors with multiple cable passages and/or angled or curved cable passages are possible within the scope of the invention.

The invention claimed is:

1. A cable connector comprising a housing with a base substantially extending between a front side and a rear side of said connector, a first housing part mountable to said base such that said first housing part and a first portion of said base determine a cable passage configured to accommodate at least a part of a ferrule arrangement of a cable, characterized in that said cable passage and said ferrule arrangement are provided with cooperating means for locking the ferrule arrangement in the cable passage, and a second housing part comprising one or more mount beams for mounting said second housing part to said first housing part, wherein said first housing part comprises a pressing structure to force said one or more mount beams into said cable passage.

2. The cable connector of claim 1, wherein said base and said first housing part are die cast parts.

3. The cable connector of claim 1, wherein said second housing part comprises a formed sheet metal member mounted to said base such that said sheet metal member and a second portion of said base determine a second cable connector portion at said front side.

4. The cable connector of claim 1, wherein a second portion of said base comprises one or more termination blocks to terminate wires of said cable and a positioning structure to position said termination blocks.

5. A method of assembling a cable in the cable connector of claim 1, said cable comprising a plurality of wires, a shielding sheath and an outer cable jacket, comprising the steps of:

stripping a portion of said cable jacket to expose a portion of said shielding sheath and cutting said shielding sheath to obtain an exposed sheath portion;

applying an inner ferrule of said ferrule arrangement over said outer cable jacket;

folding said exposed sheath portion backwards over said inner ferrule and applying an outer ferrule with said protrusion over said cable to substantially sandwich said backward folded sheath portion between said inner ferrule and said outer ferrule;

first connecting said wires to one or more termination block of said cable connector and subsequently crimping said outer ferrule on said cable, said outer ferrule being positioned to have said protrusion received in a recessed portion of said cable passage.

6. The cable connector of claim 1, wherein said cable passage comprises at least one recessed portion configured to receive a corresponding protrusion of said ferrule arrangement.

7. The cable connector of claim 6, wherein said first portion of said base comprises said recessed portion.

8. The cable connector of claim 1, wherein said cable passage comprises a cable entry with a plurality of retention ribs.

9. The cable connector of claim 8, wherein said base and said first housing define a split plane and said retention ribs are chamfered with respect to said split plane.

10. A cable connector comprising a housing with a base substantially extending between a front side and a rear side of said connector, a first housing part mountable to said base such that said first housing part and a first portion of said base determine a cable passage configured to accommodate at least a part of a ferrule arrangement of a cable, characterized in that said cable passage and said ferrule arrangement are provided with cooperating means for locking the ferrule arrangement in the cable passage comprising at least one recessed portion configured to receive a corresponding protrusion, wherein said base and said first housing part are die cast parts, and a second housing part comprising one or more mount beams for mounting said second housing part to said first housing part, wherein said first housing part comprises a pressing structure to force said mount beams into said cable passage.

11. A cable connector comprising a housing with a base substantially extending between a front side and a rear side of said connector, a first housing part mountable to said base such that said first housing part and a first portion of said base determine a cable passage configured to accommodate at least a part of a ferrule arrangement of a cable, characterized in that said cable passage and said ferrule arrangement are provided with cooperating locking portions comprising at least one recessed portion configured to receive a corresponding protrusion for locking the ferrule arrangement in the cable passage, and a second housing part comprising one or more mount beams for mounting said second housing part to said first housing part, wherein said first housing part comprises a pressing structure to force said one or more mount beams into said cable passage.

* * * * *